US007450088B2

(12) United States Patent
Kwak et al.

(10) Patent No.: US 7,450,088 B2
(45) Date of Patent: Nov. 11, 2008

(54) APPARATUS AND METHOD FOR GENERATING DIGITAL PULSE

(75) Inventors: Han-tak Kwak, Suwon-si (KR); Sung-soo Kim, Suwon-si (KR); Sang-soo Lee, Seoul (KR); Sung-hun Cho, Busan Metropolitan (KR); Ja-yeon Kim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 707 days.

(21) Appl. No.: 10/743,029

(22) Filed: Dec. 23, 2003

(65) Prior Publication Data

US 2004/0136482 A1 Jul. 15, 2004

(30) Foreign Application Priority Data

Dec. 27, 2002 (KR) ..... 10-2002-0085442

(51) Int. Cl.
*G09G 3/28* (2006.01)

(52) U.S. Cl. ..... 345/60; 345/87

(58) Field of Classification Search ..... 345/87–102, 345/204, 60–67; 348/558, 222.1; 313/169.1, 313/169.4; 375/354
See application file for complete search history.

(56) References Cited

U.S. PATENT DOCUMENTS

| | | | | |
|---|---|---|---|---|
| 4,503,407 | A * | 3/1985 | Ogura | 399/21 |
| 2002/0085120 | A1* | 7/2002 | Yamaguchi et al. | 348/558 |
| 2002/0153917 | A1* | 10/2002 | Tanaka et al. | 324/765 |
| 2006/0123299 | A1* | 6/2006 | Tanaka et al. | 714/736 |

FOREIGN PATENT DOCUMENTS

KR 2001-0097873 A 11/2001

* cited by examiner

*Primary Examiner*—Nitin Patel
(74) *Attorney, Agent, or Firm*—Sughrue Mion, PLLC

(57) ABSTRACT

An apparatus and method for generating digital pulse used to control or drive a device or a mechanism using a processing unit. The apparatus includes a processing unit, when a signal is input, operating a predetermined program to generate pulse data corresponding to the signal, and a digital pulse output unit synchronizing pulse data generated in the processing unit with an output clock signal and outputting the pulse data as the digital pulse.

10 Claims, 2 Drawing Sheets

FIG. 2A
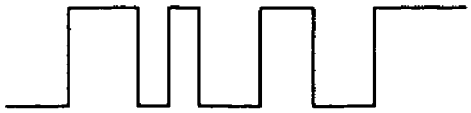
FIG. 2B
0 1 0 1 0 1 0 1 : PULSE WAVEFORM DATA
FIG. 2C
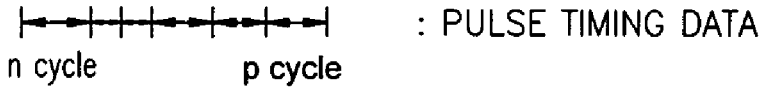
FIG. 3
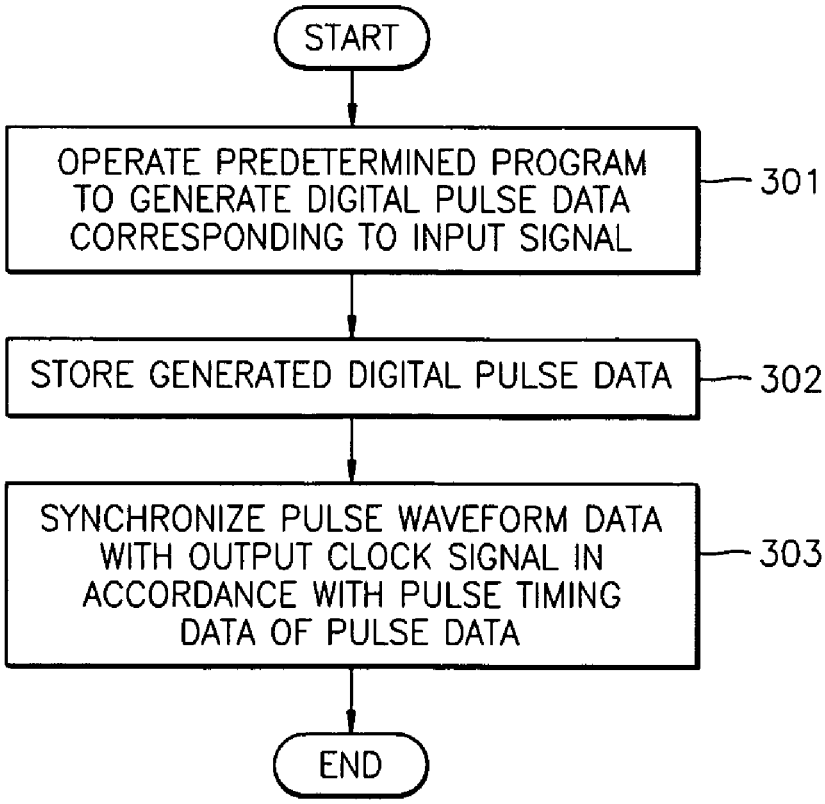

APPARATUS AND METHOD FOR GENERATING DIGITAL PULSE

This application claims the priority of Korean Patent Application No. 2002-85442, filed on Dec. 27, 2002, in the Korean Intellectual Property Office, the disclosure of which is incorporated herein in its entirety by reference.

BACKGROUND OF THE INVENTION

1. Field of the Invention

The present invention relates to an apparatus and method for generating digital pulse, and more particularly, to an apparatus and method for generating digital pulse used to control or drive a device or a mechanism.

2. Description of the Related Art

Devices that are driven or controlled by digital pulse include an image display device, such as a plasma display panel (PDP), and a tracking device, for example. In addition, a mechanism that is driven or controlled by digital pulse includes motors, for example. Existing apparatuses for generating the digital pulse are designed based on hardware using a digital circuit, an application-specific integrated circuit (ASIC), a programmable logic device (PLD) or a finite state machine (FSM).

Thus, the apparatuses for generating digital pulse should be redesigned whenever the characteristics of the devices or mechanism are changed. As such, a long development period and many costs are required. In particular, when the apparatuses for generating digital pulse are designed as the FSM, their structures are complicated, and thus, there are difficulties in design change.

SUMMARY OF THE INVENTION

The present invention provides an apparatus and method for generating a digital pulse used to control or drive a device or a mechanism via software. The present invention also provides an apparatus and method for generating digital pulse used to control or drive a device or a mechanism using a processing unit.

Further, the present invention provides an apparatus and method for generating digital pulse used to control or drive a device or a mechanism using hardware and software.

In addition, the present invention provides an apparatus and method for generating digital pulse used to control or drive a device or a mechanism using a central processing unit (CPU) and a first in first out (FIFO) buffer.

Further, the present invention provides an apparatus and method for generating digital pulse used to control or drive a video display device using software.

The present invention also provides an apparatus and method for generating digital pulse used to control or drive a video display device using a central processing unit (CPU) and a first in first out (FIFO) buffer.

According to an aspect of the present invention, there is provided a digital pulse generating apparatus, including a processing unit, when a signal is input, operating a predetermined program to generate pulse data corresponding to the signal, and a digital pulse output unit synchronizing pulse data generated in the processing unit with an output clock signal and outputting the pulse data as the digital pulse.

According to another aspect of the present invention, there is provided a digital pulse generating method, including operating a predetermined program to generate pulse data corresponding to a signal, and synchronizing the pulse data generated with an output clock signal and outputting the pulse data as digital pulse.

According to yet another aspect of the present invention, there is provided a digital pulse generating apparatus, including a processing unit, when a signal is input, operating a pulse data generation program that is set in accordance with the characteristic of the video display device to generate pulse data corresponding to the input signal, and a digital pulse output unit synchronizing pulse data generated in the processing unit with an output clock signal and outputting the pulse data as the digital pulse.

BRIEF DESCRIPTION OF THE DRAWINGS

The above and other aspects and advantages of the present invention will become more apparent by describing in detail preferred embodiments thereof with reference to the attached drawings in which:

FIGS. 2A through 2C illustrate examples of pulse data generated in a CPU shown in FIG. 1; and FIG. 3 is a flowchart of a method for generating digital pulse according to an embodiment of the present invention.

DETAILED DESCRIPTION OF THE INVENTION

Figure 1:
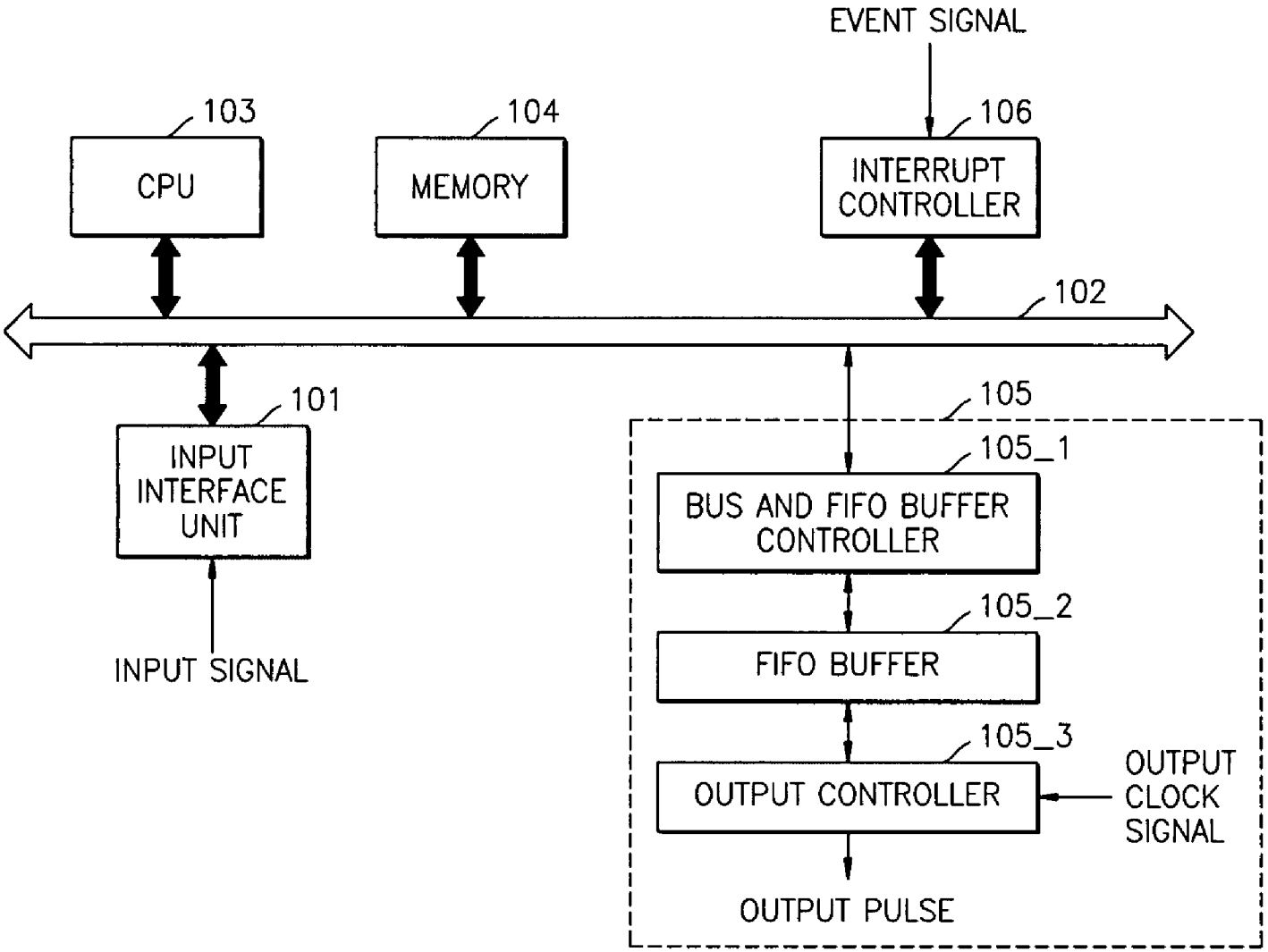
FIG. 1 is a block diagram of an apparatus for generating digital pulse according to an embodiment of the present invention.

Hereinafter, exemplary embodiments of the present invention will be described in detail with reference to the accompanying drawings.

FIG. 1 is a block diagram of an apparatus for generating digital pulse according to an embodiment of the present invention. Referring to FIG. 1, the apparatus includes an input interface unit 101, a system bus 102, a central processing unit (CPU) 103, a memory 104, a digital pulse output unit 105, and an interrupt controller 106.

When a signal is input into the input interface unit 101, the input interface unit 101 transmits the signal to the CPU 103 via the system bus 102. When the signal is an analog signal, the input interface unit 101 may be configured so that the signal is converted into a digital signal that can be recognized by the CPU 103 and output. The signal may be a control signal used to control or drive a device or a mechanism which is an object to be controlled or driven, or a source signal that is to be displayed on the device or mechanism. For example, if the device or mechanism which is the object to be controlled or driven is a video display device, such as a plasma display panel (PDP), the input signal may be a video signal.

The system bus 102 is configured so that data transmission between all the components that exist in the digital pulse generating apparatus is performed. The CPU 103 stores the input signal transmitted from the input interface unit 101 via the system bus 102 in a register (not shown) included in the CPU 103. The CPU 103 operates a program that exists in the CPU 103 to generate digital pulse data corresponding to the input signal stored in the register. The program is set in accordance with the characteristic of the device or mechanism which is the object to be controlled or driven. The program is a program for generating digital pulse required to operate the device or mechanism which is the object to be controlled or driven. The program may be configured so that desired digital pulse data is generated by performing a series of operation procedures based on the input signal. If the program is configured of a structure having generable digital pulse data, the CPU 103 may be operated so that corresponding digital pulse data is searched for from digital pulse data contained in the program and the corresponding digital pulse data is generated.

The pulse data generated from the CPU 103, as shown in FIGS. 2B and 2C, includes pulse waveform data and pulse timing data. In other words, if the pulse data generated from the CPU 103 is the same as shown in FIG. 2A, the pulse data generated from the CPU 103 may include pulse waveform data shown in FIG. 2B and pulse timing data shown in FIG. 2C. Thus, a pulse data output from the CPU 103 may be composed of a combination of pulse waveform data (0 or 1) and pulse timing data (n cycle or p cycle). The n cycle or p cycle means a multiple of an output clock signal. In other words, the n cycle is n times of the output clock signal, and the p cycle is p times of the output clock signal.

The memory 104 stores the program that is operated by the CPU 103. If the program is stored in the memory 104, the CPU 103 reads the program stored in the memory via the system bus 102, loads the program in the CPU 103, and then, operates the program.

If a program comprising generable digital pulse data is stored in the memory 104 and a program for executing a series of operation procedures for generating the pulse data exists in the CPU 103, the CPU 103 performs an operation on the input signal through the series of operation procedures by operating the program that exists in the CPU 103 and searches for and generates the digital pulse data stored in the memory 104 using a result of the operation on the input signal.

The digital pulse output unit 105 includes a bus and first in first out (FIFO) buffer controller 105_1, a FIFO buffer 105_2, and an output controller 105_3.

The bus and FIFO buffer controller 105_1 stores the pulse data transmitted from the CPU 103 via the system bus 102 in the FIFO buffer 105_2.

The output controller 105_3 reads the pulse data stored in the FIFO buffer 105_2, adjusts the width of output digital pulse by referring timing information contained in the read pulse data, and outputs digital pulse synchronized with an output clock signal. The output clock signal is the same as a clock signal used in the device which is the object to be controlled or driven.

The interrupt controller 106 generates an interrupt signal to the CPU 103 via the system bus 102 whenever an event signal is input from outside. When the pulse data generating program operated by the CPU 103 comprises a plurality of sequences or routines, the event signal is a signal to be input in an environment that is operated by selecting a sequence appropriate for situations.

Thus, whenever an interrupt signal is generated in the interrupt controller 106 by input of the event signal, the CPU 103 selects one pulse data generation sequence from a plurality of previously-set operable pulse data generation sequences. Selection of the pulse data generation sequence is performed in response to an input signal. In other words, when an interrupt signal is received via the system bus 102, the CPU 103 selects one pulse data generation sequence from the plurality of pulse data generation sequences based on the input signal transmitted from the input interface unit 101 and uses the selected pulse data generation sequence to generate pulse data corresponding to a signal that is to be input later.

For example, if the device which is the object to be controlled or driven is a video display device, such as a PDP, after the interrupt signal is received, if as an analysis result of the input signal transmitted from the input interface unit 101, the input signal is recognized as a vertical synchronous signal, and the CPU 103 selects a pulse data generation sequence corresponding to the vertical synchronous signal. If the input signal is recognized as a horizontal synchronous signal, the CPU 103 selects a pulse data generation sequence corresponding to the horizontal synchronous signal.

FIG. 3 is a flowchart of a method for generating digital pulse according to an embodiment of the present invention. Referring to FIG. 3, when an input signal is input, in process 301, the digital pulse generating apparatus generates digital data corresponding to the input signal by a previously-set program. Generation of digital data is performed by a method defined in the CPU 103 of FIG. 1. In process 302, the apparatus stores the generated digital data.

In process 303, pulse waveform data of the stored digital data is synchronized with an output clock signal and output. In this case, the width of the output digital pulse is adjusted in accordance with pulse timing data contained in the digital pulse data. In other words, a value (1 or 0) of output digital pulse waveform is maintained as the pulse timing data.

If an available program or sequence for generating digital pulse data is plural, if an interrupt signal is generated in response to an event signal that is input from outside, after the interrupt signal is generated, according to an analysis result of the input signal, one digital pulse data generation program or an appropriate digital pulse data generation sequence is selected form the plurality of digital pulse data generation programs, and then, processes 301 through 303 can be repeatedly performed.

If the apparatus for generating digital pulse is an apparatus for generating XY timing pulse of a PDP, digital pulse output from the apparatus is XY timing pulse, and a software that is operated by the CPU 103 is a software that can generate digital pulse data corresponding to XY timing pulse appropriate for the characteristic of a corresponding PDP.

In addition, the apparatus for generating digital pulse may be used as an apparatus for generating digital pulse used to control or drive a motor control device or tracking device. In this case, the software that is operated by the CPU 103 is a software that can generate digital pulse according to the characteristic of the motor control device or tracking device.

As described above, in the apparatus and method for generating digital pulse according to the present invention, digital pulse used to control or drive a device or a mechanism is generated by a software method using a CPU, such that, when the generation format of digital pulse corresponding to an input signal should be changed due to change in the characteristic of an object to be controlled or driven, the format of digital pulse generated by changing a software to generate pulse data or digital pulse data can be changed. Thus, the format of generated digital pulse can be easily changed.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. An apparatus for generating a sequence of digital pulses used to control or drive a device or a mechanism, the apparatus comprising:

a processing unit, when a signal is input, operating a predetermined program to generate pulse data corresponding to the signal; and a digital pulse output unit synchronizing pulse data generated in the processing unit with an output clock signal and outputting the pulse data as the sequence of digital pulses, wherein the pulse data includes pulse waveform data and pulse timing data, and the digital pulse output unit adjusts the width of at least one of the sequence of digital pulses that is output by referring to the pulse timing data.

2. The apparatus of claim 1, wherein the predetermined program is set in accordance with the characteristic of an object to be controlled or driven.

3. The apparatus of claim 1, further comprising a memory, which stores the predetermined program.

4. The apparatus of claim 1, wherein the digital pulse output unit includes a first in first output (FIFO) buffer, the pulse data is stored in the FIFO buffer, the pulse data in the FIFO buffer is synchronized with the output clock signal and output.

5. The apparatus of claim 1, wherein, if the predetermined program is composed of a plurality of pulse data generation sequences, whenever an interrupt signal is received, the processing unit selects one pulse data generation sequence from the plurality of pulse data generation sequences in response to the input signal and generates pulse data corresponding to the input signal based on the selected pulse data generation sequence.

6. A method for generating a sequence of digital pulses used to control or drive a device or a mechanism, the method comprising:

operating a predetermined program to generate pulse data corresponding to a signal, wherein the pulse data includes pulse waveform data and pulse timing data;

synchronizing the pulse data generated with an output clock signal;

adjusting the width of at least one of the sequence of digital pulses that is output by referring to the pulse timing data; and outputting the pulse data as the sequence of digital pulses.

7. The method of claim 6, wherein the predetermined program is set in accordance with the characteristic of an object to be controlled or driven.

8. The method of claim 6, wherein, if the predetermined program is composed of a plurality of pulse data generation sequences, the generating the pulse data, whenever an interrupt signal is received, is selecting one pulse data generation sequence from the plurality of pulse data generation sequences in response to the input signal and generating pulse data corresponding to the input signal based on the selected pulse data generation sequence.

9. An apparatus for generating a sequence of digital pulses used to control or drive a video display device, the apparatus comprising:

a processing unit, when a signal is input, operating a pulse data generation program that is set in accordance with the characteristic of the video display device to generate pulse data corresponding to the input signal; and a digital pulse output unit synchronizing pulse data generated in the processing unit with an output clock signal and outputting the pulse data as the sequence of digital pulses, wherein the pulse data includes pulse waveform data and pulse timing data, and the digital pulse output unit adjusts the width of at least one of the sequence of digital pulses that is output by referring to the pulse timing data.

10. The apparatus of claim 9, wherein the video display device is a plasma display panel, and the pulse data generation program is a program for generating XY timing waveform appropriate for the plasma display panel.

* * * * *